United States Patent [19]

Richmond

[11] 4,160,193

[45] Jul. 3, 1979

[54] METAL VAPOR ELECTRIC DISCHARGE LAMP SYSTEM

[76] Inventor: Abraham W. Richmond, 162 Haven Dr., West Melbourne, Fla. 32901

[21] Appl. No.: 852,552

[22] Filed: Nov. 17, 1977

[51] Int. Cl.[2] ..... H05B 41/16; H05B 41/24

[52] U.S. Cl. ..... 315/281; 323/51; 315/DIG. 4

[58] Field of Search ..... 315/276, 281, 282, DIG. 4; 323/51

[56] References Cited

U.S. PATENT DOCUMENTS

| | | | |
|---|---|---|---|
| 772,096 | 10/1904 | Hallberg | 323/51 |
| 3,873,910 | 3/1975 | Willis, Jr. | 315/DIG. 4 |

*Primary Examiner*—Alfred E. Smith
*Assistant Examiner*—Robert E. Wise
*Attorney, Agent, or Firm*—John B. Armentrout

[57] ABSTRACT

A lamp system is provided wherein a high radiation intensity metal vapor electric discharge lamp is matched with a controllable regulating transformer which is characterized by having a sufficiently high open circuit voltage for striking an arc across the lamp and by having loose coupling between primary and secondary windings along with high impedance of the secondary winding sufficient for limiting an initially high starting current through the lamp to a value whereby, as the lamp warms up on power from the transformer, the lamp current decreases and the voltage across the lamp increases, allowing the lamp to reach a high radiation intensity level of operation, the system further being one in which the transformer is controlled by having controllable core structure to select a different intensity level of operation of the lamp.

18 Claims, 7 Drawing Figures

Fig. 4
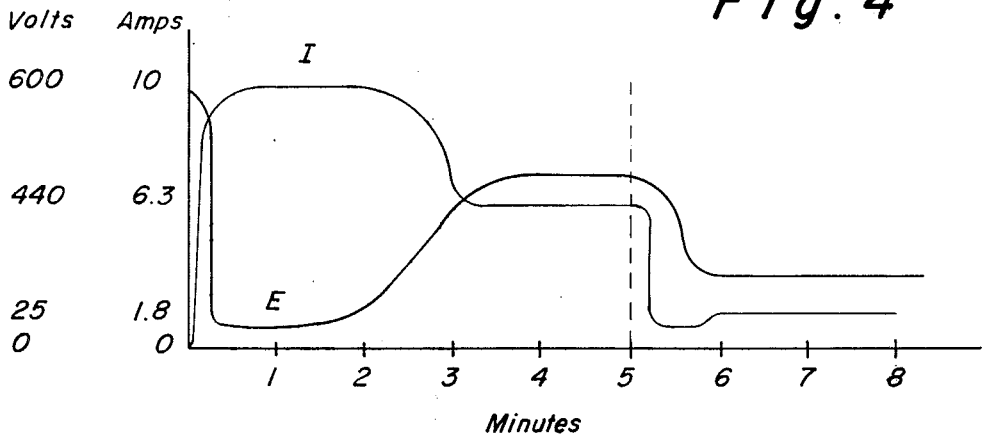
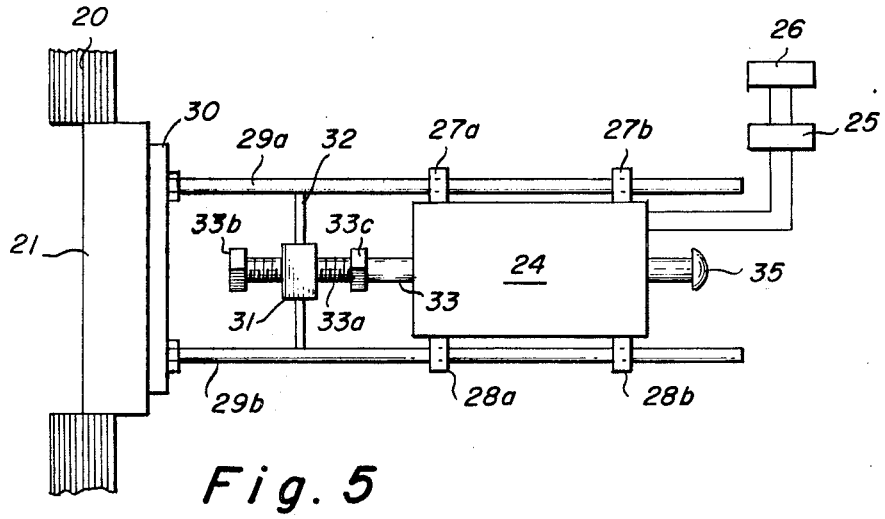
Fig. 5
Fig. 6
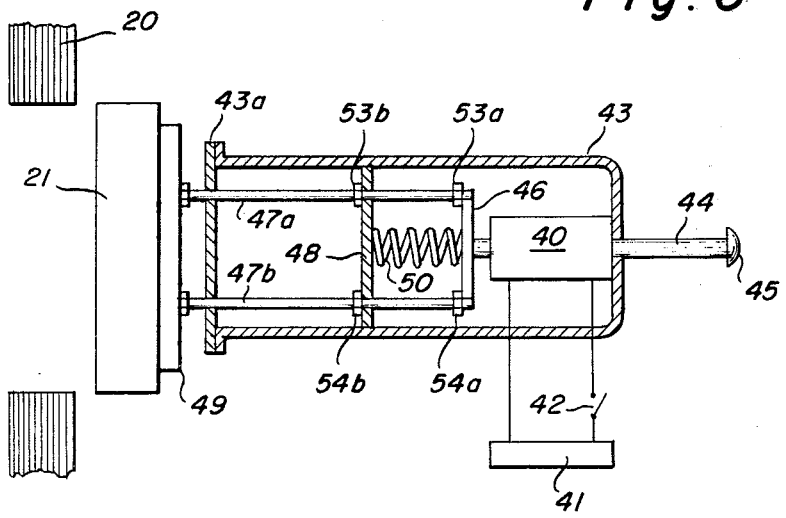

+15V
R8
R7
R6
R5
S3
X
X
R10
70
D6
D7
D5
D8
C1
71
69
12'
T1
66
67
65
68
62
63
17'
21'
24'
11'
14'
f1
f2
S4
S1
60
61
R11
82
R13
Q5
-15V
R12
R15
+15V
R14
R16
R17
85
D3
D4
R1
R2
98
99
Q3
Q4
92
Q1
Q2
90
91
D1
D2
80
81
79
78
77
76
T3
75
S2
73
74

METAL VAPOR ELECTRIC DISCHARGE LAMP SYSTEM

This invention relates to lamp systems and is more particularly concerned with transformer powered high radiant power metal vapor electric discharge lamp systems.

An object of the present invention is to provide a metal vapor electric discharge lamp system wherein a low-medium-high pressure metal vapor lamp having for example a rated intensity of about 200–400 watts per inch of the lamp, and illustratively being a mercury vapor lamp, is started on electric power from a variable power output transformer thereafter to operate at an intensity level of radiation which can be modulated to a different level in response to a different power output level of the transformer being selected.

Another object of this invention is the provision of a metal vapor electric discharge lamp system wherein a variable power output transformer and a high radiant power metal vapor electric discharge lamp are interrelated for the lamp to be started under control of the transformer and maintained at about 100% full lamp power on operation of the transformer, and for the level of the radiation intensity of the operating lamp to be diminished such as to a level of about 20% full lamp radiant power or less in response to operation of the transformer at a selected lower power output level.

A further object herein is to provide a metal vapor electric discharge lamp system of the character indicated, and achieve adjustment of shunt means in the energizing transformer in the system to vary the power output level of the transformer and the radiation intensity level of the lamp.

A further object herein, according to certain practices of this invention, is the provision of a metal vapor electric discharge lamp system of the character indicated wherein the transformer power output level may selectively be relatively high or low or somewhere intermediate these two levels in energizing the high intensity metal vapor electric discharge lamp commensurately to sustain relatively high or low or intermediate levels of intensity of radiation from the lamp.

Another object of the present invention, according to certain practices thereof, is to provide a metal vapor electric discharge lamp system of the character indicated wherein the radiant power emission level of the high intensity metal vapor electric discharge lamp may be altered to be either of widely different levels by alteration of the power output level of the transformer from relatively high to relatively low.

Other objects of this invention in part will be obvious and in part pointed out more fully hereinafter.

The present invention provides control over the intensity level of radiation from a high radiant power metal vapor electric discharge lamp, such as a lamp anywhere within the full emission power range of approximately 100 watts to 20,000 watts, and preferably a low-medium-high pressure lamp having a rated intensity of about 200 to 400 watts per inch, and the invention makes available high intensity metal vapor electric discharge lamp systems wherein the level of the intensity of radiation of the operating lamp can be adjusted for the lamp to continue to operate after the adjustment has been made. Need for adjustment of this sort applicable to a high intensity metal vapor electric discharge lamp, rated as noted above, is vast, and for example is encountered where using the lamp in ultraviolet curing of inks or paints on substrates of metal, paper, plastics, fabric, wood, laminates, or the like, or for the illumination of streets or parking lots, or other areas which require lighting.

In order to provide insight to certain advantages of the present invention as applied for example to practices thereof involving the curing of inks, paints, or of other materials which respond to ultraviolet rays emitted from high intensity metal vapor electric discharge lamps, problems heretofore have been encountered relating to the fact that intense radiant heat produced from such lamps can cause damage where the period of time for which the work can safely be exposed to high level infra red radiation from the lamp has been exceeded. More generally, the present invention offers high radiant power metal vapor electric discharge lamp systems which provide different lamp radiation intensity levels, starting for example at a full emission level which can be reduced if need be to a lower emission level, such as to levels including those below about 70% full lamp power. The intensity of the lamp operating at full power may for example be reduced to spare work under ultraviolet treatment from being damaged by heat of the lamp. It is observed in this regard that with modulating control over the intensity of for example a high power mercury vapor lamp, radiation in the infra red range reduces relatively sharply in response to a reduction in the lamp intensity as compared with radiation in the ultraviolet range. The ultraviolet radiation also reduces, but tends to level off as the lower emission levels of the lamp are reached.

In preferred embodiments in accordance with this invention, a high intensity metal vapor electric discharge lamp system is provided wherein a high radiation intensity metal vapor electric discharge lamp is connected for starting and operating in the secondary circuit of a controllable regulating transformer in the absence of heretofore known capacitors or similarly intended controls being used in the secondary circuit in the lamp. The over all impedance of the transformer and the impedance of the lamp are matched to supplement one another for controlling the lamp through starting the lamp, and the lamp to operate stably after starting. The transformer includes a main magnetic core portion loosely coupling the transformer primary and secondary windings, and movable shunt core means for power to the high intensity metal vapor electric discharge lamp to be modulated, such as enabling the lamp to operate within a range of emission levels down to the vicinity of about 20% full lamp emission. With the movable shunt core means partially or fully removed from the main low reluctance portion of the magnetic core linking the transformer primary and secondary windings, an increased magnetic linking is had of the transformer primary and secondary windings for increasing the power output of the transformer to the high intensity metal vapor electric discharge lamp for starting the lamp and maintaining operation of the lamp at substantially full radiant power level of the lamp. Starting of the high intensity metal vapor electric discharge lamp on operation of the transformer is promoted by an applied high open circuit voltage of the transformer to strike an arc across the lamp terminals, following which the transformer by having loose coupling between primary and secondary windings along with high impedance of the secondary winding limits a resultingly high lamp current to correspond to a low voltage condition across the lamp. As the lamp warms up, the voltage across the lamp increases and the current through the lamp decreases allowing the lamp to take on steady operation at substantially full radiation intensity level, meanwhile having the current through the lamp and the voltage across the lamp steady. When the shunt core means is advanced to a position within or farther within the magnetic field of the main core portion of the transformer, magnetic flux from the transformer primary winding courses in an increased amount across the shunt core means and by-passes the transformer secondary winding, and impedance of the primary winding is thus increased reducing the primary or excitation current as the transformer power output is reduced. This immediately reduces the lamp current from the secondary winding and allows the transformer output voltage to the lamp to remain substantially without change, accordingly producing a lower radiation intensity level of operation of the lamp. Lamp current in finally settling to be that corresponding to the lower radiation intensity level of the lamp remains substantially stable with time, meanwhile having the voltage across the lamp reduce in a lagging manner and stabilize.

In the accompanying drawing representing several embodiments of the present invention:

FIG. 4 is a diagram relating to operation of the system of FIG. 1 and is representative of lamp current and lamp voltage with respect to time through the lamp being started and operated at a first power output level of the transformer and through the lamp being controlled to respond to and operate at a lower power output level of the transformer;

FIG. 5 is a sectional elevation of the transformer taken at line 5—5 in FIG. 1, the shunt means being in an intermediate position relatively to the remainder of the transformer core, and the figure further represents reversible motor and drive means used for varying the position of the shunt means;

Figure 7:
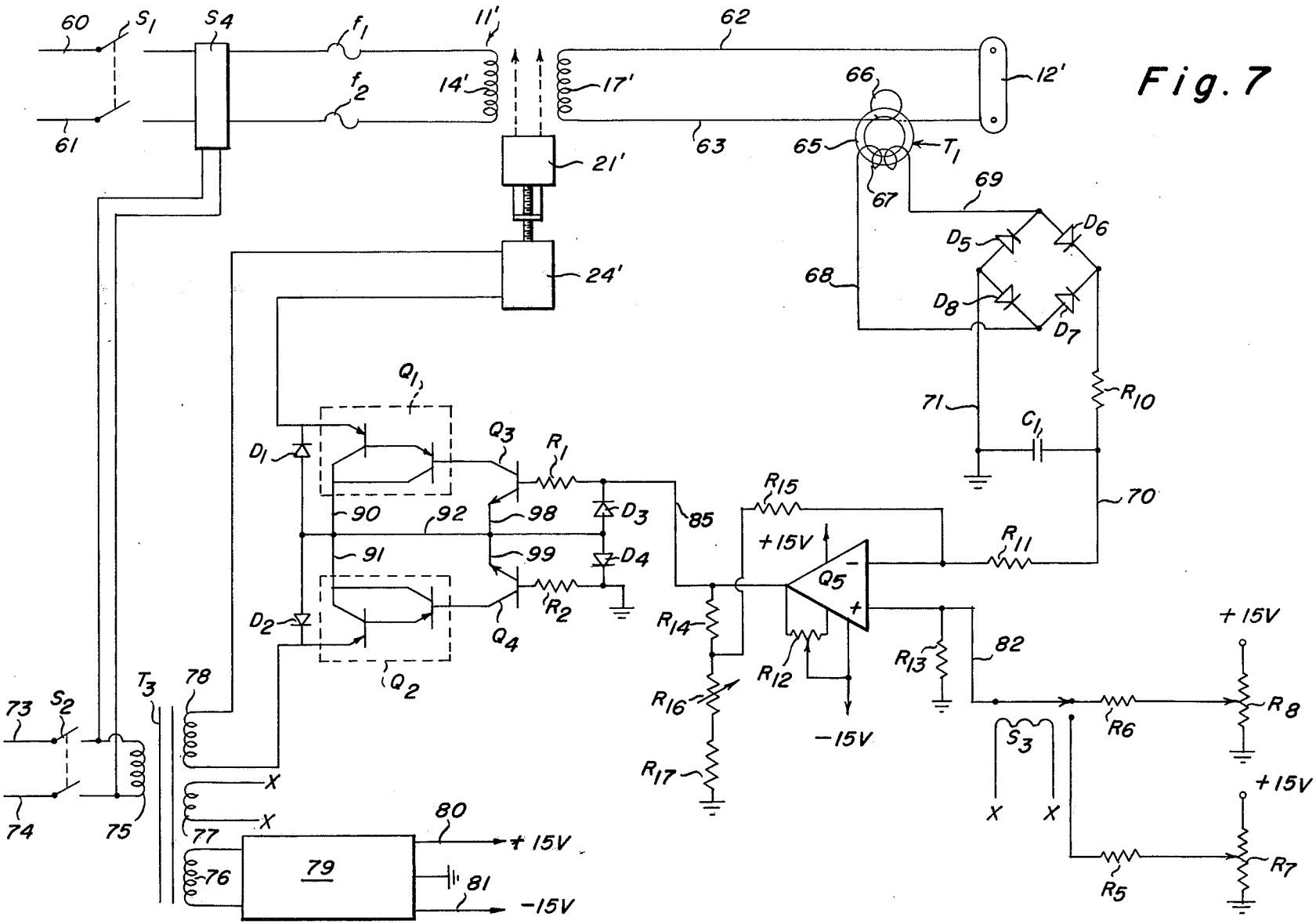

FIG. 6 corresponds to FIG. 5 but represents a modified means, inclusive of a solenoid, for selecting position of the shunt core means; and FIG. 7 is a circuit diagram of a further modified form of system in accordance with the present invention.

Figure 1:
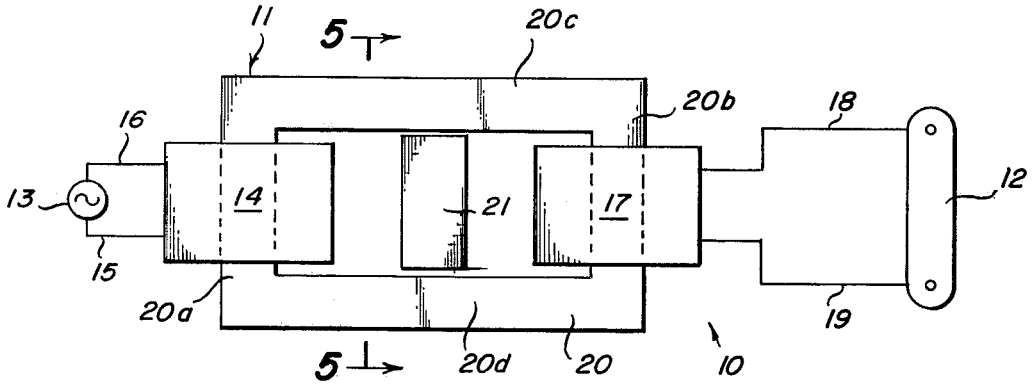
FIG. 1 represents a metal vapor electric discharge lamp system and includes a plan view of a transformer having movable shunt means in the core thereof for controlling the transformer power output.
Figure 2:
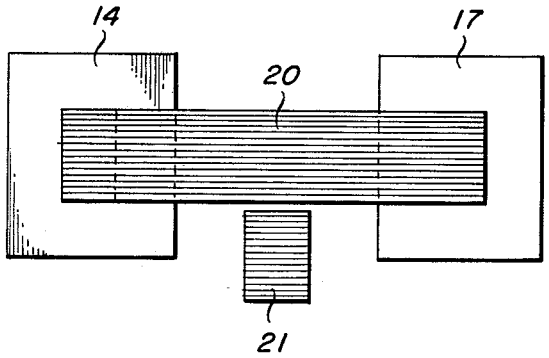
FIG. 2 is a side elevation of the transformer of FIG. 1 with the movable shunt means having a position which is substantially fully removed from the magnetic field of the main core portion of the transformer and corresponds to maximum power output of the transformer.
Figure 3:
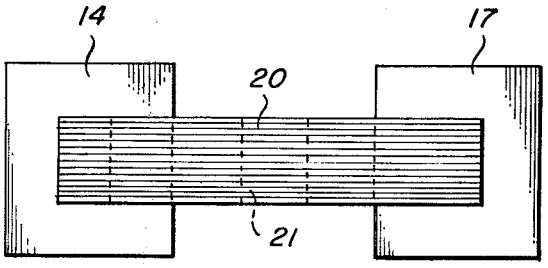
FIG. 3 is a side elevation corresponding to FIG. 2 and represents the movable shunt means in a maximum bridging position with reference to the remainder of the core, which position enables the transformer to have minimum power output when energized.

Referring now more particularly to the embodiment of this invention which is represented in FIGS. 1 to 3 of the accompanying drawing, a high intensity metal vapor electric discharge lamp system 10 is provided comprising a controllable regulating transformer 11 and a high intensity metal vapor electric discharge lamp 12. Lamp 12 is a mercury vapor lamp with a 200 watts per inch power rating, being 12.5 inches long and requiring 600 watts for starting and being operative thereafter at 420 to 450 volts and 6.3 amperes at full power. The transformer 11 has a primary winding 14 which is connected in series with a conventional source of 60-cycle 220/440 volt alternating current supply 13 through leads 15 and 16, and a secondary winding 17 of the transformer is connected in series with lamp 12 through leads 18 and 19 to opposite end terminals of the lamp. A magnetic core of the transformer 11 includes a low reluctance main rectangular core portion 20. Opposite parallel legs **20*a* and 20*b* of the main core portion are surrounded by the primary winding 14 and the secondary winding 17 while intermediately of those legs the magnetic core further is provided with opposite parallel legs 20*c* and 20*d* forming a main magnetic flux path with the legs 20*a* and 20*b*** which links the primary and secondary windings aforementioned.

The magnetic core of transformer 11 has laterally movable magnetic shunt core means 21 which longitudinally extends generally parallel with legs **20*a* and 20*b* of the main core portion 20, and the shunt core means is mechanically operative laterally to and from positions wherein the shunt core means is either substantially outside the magnetic field of the main magnetic core portion 20 (see FIG. 2) or is disposed between the legs 20*c* and 20*d* of the main core portion 20 to form short air gaps at opposite ends with the legs 20*c* and 20*d* intermediately of the primary and secondary windings 14 and 17**, such as with the shunt core means being in the fully inserted position represented in FIG. 3.

Transformer 11 has a 600 volt open circuit output voltage accordingly to promote starting of the mercury vapor lamp 12 on power supplied from the transformer secondary winding 17, and is adapted to couple 25 to 50 volts on the lamp at 9.5 amperes during starting of the lamp, and later operates at about 440 volts with 6.3 amperes to sustain substantially full power operation of the lamp.

Let it be assumed now that the shunt core means 21 of the transformer 11 is in the FIG. 2 position and therefore is substantially outside the magnetic field of the main magnetic core means 20 while the transformer 11 is energized. As will be more readily understood by referring to FIG. 4, which shows voltage and current curves with respect to time for the mercury vapor lamp 12, an arc is initially struck across the lamp in response to a voltage of about 600 volts supplied from the transformer secondary winding 17, whereupon the voltage across the lamp rapidly decreases to the region of 25 to 50 volts and a lamp current in the vicinity of 9.3 amperes prevails, during which time mercury in the lamp is vaporizing under heat with an accompanying ionization within the lamp. Thereafter, over a period of time of up to about 3 minutes, the lamp pressure increases and the current through the lamp decreases accompanied with an increasing voltage output from the transformer. This leads to a leveling out of the lamp current and of the lamp voltage in the respective regions of 6.3 amperes and 440 volts, following which these current and voltage values are substantially maintained to give stable operation of the lamp at full radiant power level.

For an understanding of operation of the lamp 12 at lower emission levels, let it be assumed first that the lamp is operating at full power level, having reached that level in the manner described in the preceding paragraph, and that the shunt core means 21 then is shifted to the position represented in FIG. 3 and therefore is in position for the lamp 12 to operate at a minimum radiation power level. As will be seen by referring again to the voltage and current diagrams in FIG. 4, the lamp current sharply drops to a level of current which is substantially stably held, before and after the voltage across the lamp with cooling and a reduction of pressure in the lamp diminishes to a reduced stabilized level and reaches that level by a period of time of about one minute following the reduction of power from the transformer 11 to diminish the lamp intensity from the full emission level. System 10 is adapted to maintain the latter stabilized operation until the shunt core means 21 is again laterally moved to vary the amount of magnetic flux reaching the transformer secondary winding 17, and for each different position given the shunt core means 21 intermediately of the FIG. 2 and FIG. 3 positions referred to above, whether to decrease or to increase the radiation power level of the mercury vapor lamp 12, the system 10 responds by having the lamp stably operate at a correspondingly different radiation power level.

Position of the magnetic shunt core means 21 relative to the main core portion 20, and therefore position of the magnetic shunt core means for controlling output power of the transformer 11 and the intensity of the metal vapor electric discharge lamp 12, is achieved either manually or through use of power drive means which in the present embodiment is a reversible rotary electric motor 24 (see FIG. 5) having a reversing on-off switch 25 and operating from a suitable source of power 26. The motor 24, on the housing thereof, carries pairs of fixed guides 27*a* and 27*b* and 28*a* and 28*b*, which slidably receive in apertures therein a pair of rods 29*a* and 29*b* connected at their ends remote from the motor with the magnetic shunt core means 21. The connection includes a shield 30 substantially to isolate the rods 29*a* and 29*b* magnetically from the transformer 11. With the transformer 11 and motor 24 being suitably fixed in position, the rods 29*a* and 29*b* support the magnetic shunt core means 21 for the latter to be moved to and from the FIGS. 2 and 3 positions relatively to the main core member 20 wherein the transformer has maximum and minimum power outputs respectively. This movement is achieved through having a helically threaded portion 33*a* of the motor armature shaft 33 threadedly engaged with a nut 31. Nut 31 is supported by means of a strut 32 interconnecting the slide rods 29*a* and 29*b* to move with those rods. The motor armature shaft 33 is further provided with stops 33*b* and 33*c* at the respective ends of the threaded portion 33*a* of that shaft for the stop 33*b* to be against the nut 31 when the magnetic shunt core means 21 is in the FIG. 2 position and for the stop 33*c* to be against the nut 31 when the magnetic shunt core means 21 is in the FIG. 3 position. Through use of the on-off motor reversing switch 25, the rotary electric motor 24 may be started in forward and reverse directions and stopped to select position of the magnetic shunt core means 21 to be either of the FIGS. 2 and 3 positions, or infinitely variably to be any one of a number of intermediate positions such as the position represented in FIG. 5 for the transformer 11 to operate the metal vapor electric discharge lamp 12 at a level of radiation intensity varying with the particular intermediate position of the magnetic shunt core means 21. With motor 24 de-energized through switch 25, the motor armature shaft may be manually rotated through use of a hand knob 35 on the armature shaft, accordingly to select the radiation intensity level of lamp 12.

In certain embodiments of the present invention, quick-acting motive power drive means, such as a solenoid 40 represented in FIG. 6, acting rectilinearly, is utilized, thus for example to replace the shifting drive for the magnetic shunt core means 11 according to FIG. 5. Referring further to FIG. 6, it will be noted in this regard that the solenoid 40, having its winding connected in series with a switch 42 and a suitable source of power supply 41, is supported to a casing 43 through which one end of the armature 44 of the solenoid protrudes and is connected with a manual control knob 45. The opposite end of the armature 44 is secured to a member 46 which interconnects a pair of slide rods 47*a* and 47*b*, the latter two rods being guidedly received through apertures by a strut 48 fastened inside the casing 43 and by an end wall 43*a* of the casing, and have ends outside the casing connected with the magnetic shunt core means 21. The latter connection includes a shield 49 substantially to isolate the rods 47*a* and 47*b* magnetically from the transformer 11.

With the transformer 11 and casing 43 being suitably fixed in position, the rods 47*a* and 47*b* support the magnetic shunt core means 21 for the latter to be moved to and from the FIGS. 2 and 3 positions. A helical spring 50 is interposed securely between the strut 48 and member 46 which interconnects the pair of rods 47*a* and 47*b*, and the spring 50 biases the interconnecting member 46 and slide rods 47*a* and 47*b* to move the magnetic shunt core means 21 to the FIG. 6 position, which corresponds to that in FIG. 2, thus for the transformer 11 to operate at maximum output power level. Under the latter conditions, the solenoid 40 is de-energized by having the switch 42 in open circuit position. When the switch 42 is closed, the solenoid 40 is energized, causing the armature 44 to introduce thrust counter to that of the spring 50, thereby suddenly driving the rods 47*a* and 47*b* with their interconnecting member 46 to carry the magnetic shunt core means 21 to the left in FIG. 6 until the magnetic shunt core means attains the FIG. 3 position which corresponds to minimum power output of the transformer 11 for energizing the metal vapor electric discharge lamp 12. A pair of stops 53*a* and 54*a* securely on the rods 47*a* and 47*b* meanwhile are against the strut 48 for arresting further movement of the solenoid armature 44 to the left in FIG. 6. When the switch 42 is once more opened, the magnetic shunt core means 21 resumes the FIGS. 2 and 6 position by having the spring 50 act, moving the rods 47*a* and 47*b* and the interconnecting member to the right in FIG. 6 until a pair of stops 53*b* and 54*b* securely on the rods 47*a* and 47*b* come into contact with the strut 48. With the switch 42 still open, the minimum power output level of the transformer 11 may be selected by manually depressing the knob 45, and maximum power operation of the transformer 11 will be resumed following release of the knob.

In certain embodiments in accordance with the present invention, an automatic feedback control is utilized for controlling position of the shunt core means in a transformer, of the character referred to hereinbefore, to correspond to a thus selected radiation intensity level of operation of the lamp. Referring to FIG. 7, which is representative of an embodiment of the latter kind of control, the transformer 11', similar in all respects to the transformer of FIGS. 1 to 3, inclusive, comprises a shunt core means 21' which is screw-driven and is guided similarly to the shunt core means in FIG. 5, though the drive motor 24' used in the present embodiment is identified more specifically as being a reversible d.c. motor such as of about 24 volt rating.

Motor 24' is controlled by the feedback circuit of FIG. 7 for the shunt core means 21' of the transformer 11' to reach any of a number of selected positions relative to the main core portion of the transformer 11', thus to promote a corresponding maximum, minimum or intermediate radiation intensity level of operation of a mercury vapor lamp 12'. Moreover, for starting the lamp 12', the shunt core means 21', by feedback control, is automatically brought to a lamp starting position with reference to the main core portion of the transformer 11', and in the present embodiment this position corresponds, as preferred, to substantially full transformer power energization of the lamp 12'. Lamp 12' is characterized by having a 200 watts per inch power rating, by being 12.5 inches long and requiring 600 watts for starting, and by being operative thereafter at 420 to 450 volts and 6.3 amperes at full power. Transformer 11' has a 600 volt open circuit output voltage, accordingly to promote starting of the mercury vapor lamp 12', and is adapted to couple 25 to 50 volts on the lamp at 9.5 amperes during starting of the lamp, and later operates at about 440 volts with 6.3 amperes to maintain substantially full power lamp operation.

The primary winding 14' of transformer 11' is energized from a 220/440 volt alternating current supply, being in series with that supply through leads 60 and 61 which are controlled as to electrical continuity by ganged main line switches $S_1$, by a relay $S_4$ having normally open contacts to be closed by energization of the relay for the leads 60 and 61 to conduct, and by fuses $f_1$ and $f_2$, the relay $S_4$ being electrically between the main switches $S_1$ and the fuses $f_1$ and $f_2$, with the fuses $f_1$ and $f_2$ being electrically between the relay $S_4$ and the primary winding 14'.

The secondary winding 17' of the transformer 11' is connected in series with the mercury vapor lamp 12' through leads 62 and 63, and the lead 63 provides one convolution around the magnetic core 65 for that convolution to form the primary winding 66 of a current transformer $T_1$ which thus is sensitive to the operating current for the lamp 12'. A secondary winding 67 of the current transformer $T_1$ has leads 68 and 69 connected with a first set of terminals of a bridge type rectifier having the diodes $D_5$, $D_6$, $D_7$ and $D_8$ interrelated therein, while a second set of the bridge terminals are connected through leads 70 and 71 to an integrating circuit wherein lead 71 is grounded and a resistance $R_{10}$ is connected with lead 70 and with a condenser $C_1$, with the latter being in shunt across the leads 70 and 71, for lead 70 to carry a voltage signal which is proportional to the current in the circuit of lamp 12'.

The control system in FIG. 7 further includes a transformer $T_3$ having a primary winding 75 energized through leads 73 and 74 and the ganged line switches $S_2$ from a 60 cycle, 110 volt source of alternating current supply. A first secondary coil 76 of the transformer $T_3$ is connected to energize a rectifier 79 which is of any suitable well known type for producing +15 and −15 d.c. output voltages in leads 80 and 81 with reference to ground.

Another secondary coil 77 of the transformer $T_3$ is connected with a thermal delay switch $S_3$ controlling lead 82 to carry a reference voltage signal which in magnitude is prescribed by either of the potentiometers $R_7$ and $R_8$ including resistance elements connected at their one ends to the +15 volt supply in lead 80 and at their other ends to ground and having manually operable selectors contacting these resistances for voltage level selection and connected through resistances $R_5$ and $R_6$ to contacts of the thermal switch $S_3$. The latter-mentioned contacts may be selected one to the exclusion of the other by operation of the switch $S_3$ for connecting that contact to lead 82 and the latter to carry the appropriate reference voltage signal. Leads 70 and 82 are connected with a comparator $Q_5$ and the comparator is adapted to deliver on output to lead 85 a voltage error signal based upon comparing a voltage signal received through lead 70 and a controlling resistance $R_{11}$ with a reference voltage signal received from either of the thermal switch $S_3$ controlled branches respectively including the potentiometer $R_7$ and the potentiometer $R_8$.

Potentiometer $R_8$ is given a fixed setting for the reversible electric motor 24' to be operated for moving the shunt core means 21' in the transformer 11' automatically to a position corresponding to substantially full power output of the transformer 11' for starting the lamp 12' from a deenergized condition. Switch $S_3$ accordingly, yet to become fully heated electrically, is normally closed on the contact thereof for connecting the potentiometer $R_8$ branch with the comparator $Q_5$ and delays, such as for a period of time of about one minute, after the switch is initially energized from the secondary coil 77 of transformer $T_3$, before discontinuing connection of the $R_8$ potentiometer branch in favor of instead connecting the $R_7$ potentiometer branch with the comparator $Q_5$ through the related contact of the switch $S_3$.

The setting of the potentiometer $R_7$ may be selected by manual control or by other suitable actuation for the potentiometer to prescribe, in the particular setting received, a radiation intensity level of operation of the mercury vapor lamp 12' which level will depend upon a resulting position of the shunt core means 21' reached in response to operation of the reversible motor 24' and accordingly may be varied to be anywhere from full radiant power level down to about 20% full radiant power of the lamp by altering the setting of the potentiometer $R_7$. In this, the motor 24' is controlled by a circuit which receives a positive, negative or a zero signal on lead 85 from the comparator $Q_5$ and controls the motor to operate in a forward direction of drive, in a reverse direction of drive or be de-energized. The comparator $Q_5$ is for example an ua 741 op. amp. comparator and the comparator $Q_5$ is connected with the +15 volt and −15 volt leads 80 and 81, is equipped with a null setting $R_{12}$ potentiometer, and is controlled as to over all gain by a network including the potentiometer $R_{16}$ interposed between resistances $R_{14}$ and $R_{15}$, respectively off leads 70 and 85, and resistance $R_{17}$ to ground.

Transformer $T_3$ includes a third secondary coil 78, this for powering the reversible d.c. electric motor 24' through use of a pair of diodes $D_1$ and $D_2$ in a transistorized switching circuit by means of which the motor is controlled to operate in forward and reverse directions selectively and to stop. The collector-emitter paths 90 and 91 of a pair of darlington transistors $Q_1$ and $Q_2$ in the motor switching circuit have inputs through a lead 92 to the diodes $D_2$ and $D_1$, respectively, which are in the power supply circuit of the motor 24', having that circuit to be energized by the transformer secondary coil 78. The base of a transistor $Q_3$ is connected through a resistance $R_1$ to lead 85, and the base of a transistor $Q_4$ is connected through a resistance $R_2$ and lead 86 to ground. The collector-emitter path 98 of the transistor $Q_3$ is connected with a base of darlington transistor $Q_3$ and has input to a diode $D_4$ through lead 92, with the diode $D_4$ having output connection with the ground lead 86, and the collector-emitter path 99 of the transistor $Q_4$ is connected with a base of the darlington transistor $Q_2$ and has input through lead 92 to a diode $D_3$. The diode $D_3$ has output connection with the lead 85.

If a positive voltage error signal from the comparator $Q_5$ is encountered on lead 85, the transistor $Q_3$ is turned on through diode $D_4$ to return to ground, and the darlington transistor $Q_1$ also is rendered conductive allowing current on the positive going half cycle of the alternating current from the secondary coil 78 of the transformer $T_3$ to course from the secondary coil 78 of the transformer $T_3$ to the motor 24' and return through diode $D_2$ to the secondary winding 78. By this means, the error signal produced from the comparator $Q_5$ will cause the motor 24' to drive the shunt core means in a direction for having the shunt core means reach a position corresponding to maximum power operation of the lamp 12'. Reverse operation of the motor drive is had if a negative voltage error signal is received on lead 85 from the comparator $Q_5$. In this regard, transistor $Q_4$ is turned on, with plus in the collector-emitter path 99 being through the diode $D_3$ to minus, and the darlington transistor $Q_2$ is also turned on causing the motor power circuit to conduct on the negative going half cycle of the current from the secondary coil 78 of the transformer $T_3$ through the darlington transistor $Q_2$, diode $D_1$, motor 24' and back to the coil 78. Motor 24' responds to this current by driving the shunt core means 21' in a direction toward a position of the shunt core means corresponding to minimum power operation of the lamp 12'.

To provide for maximum starting current to course through the lamp 12', as preferred, in response to switches $S_1$, $S_2$ and $S_4$ being closed, the potentiometer $R_8$ is pre-set for producing a voltage signal on line 82 corresponding to this maximum current starting condition and thus to assure that the shunt core means 21' will be in or brought to a position wherein the transformer 11' has substantially full power output to the lamp 12' during starting of the lamp. If the voltage signal on lead 70 resulting from the actual current in the circuit of lamp 12' as sensed by the current transformer $T_2$ causes the comparator to produce no voltage error signal on the lead 85 this is indicative of the fact that the shunt core means 21' is already in position for the transformer 11' to have substantially full power output to the lamp 12', and therefore the motor 24' remains de-energized; otherwise there is a positive voltage error signal on lead 85 from the comparator $Q_5$ and the motor 24' is controlled by the switching circuit to bring the shunt core means to a position corresponding to substantially full power output of the transformer 11' and the motor then is de-energized during the starting stage of the lamp 12'. This form of control over the motor 24' is available for the approximately one minute time period that the thermal switch $S_3$ delays before moving to erase connection with the $R_8$ potentiometer branch in favor of having control of the motor 24' from the $R_7$ potentiometer take over instead of availability. The potentiometer $R_7$ may be set for the system automatically to select a maximum, minimum, or any one of a number of intermediate radiant power levels of operation of the lamp. The voltage from the $R_7$ potentiometer branch is imposed upon lead 82 as a voltage signal representing the current which is to be sustained in the circuit of lamp 12' during steady operation of the latter, and this signal is compared in the comparator $Q_5$ with the voltage signal on lead 70 representing the current which then actually is being sustained in the circuit of lamp 12'. A voltage error signal produced in the comparator $Q_5$ and representing the discrepancy in the aforementioned two signals is imposed on lead 85 and whether this voltage error signal is positive or negative the motor 24' drives the shunt core means 21' in the proper direction to erase the voltage error signal and is de-energized when the voltage error signal has been erased. The shunt core means 21' accordingly occupies a position corresponding to having the transformer 11' thereafter maintain operation of the lamp 12' at a selected radiation power level. This power level may be changed as desired by resetting the potentiometer $R_7$ and having the system accordingly re-adjust by feedback in a manner which by now is believed to be clearly understood.

As the invention lends itself to many possible embodiments and as many possible changes may be made in the embodiments hereinbefore set forth, it will be distinctly understood that all matter described and illustrated herein is to be interpreted as illustrative and not as a limitation.

I claim:

1. A metal vapor electric discharge lamp system, comprising, a low-medium-high pressure metal vapor electric discharge lamp having a rated full radiation power in the range of about 200 to 400 watts per inch of said lamp, and transformer and control means including, a transformer comprising, a primary winding energized on alternating current electrical supply, a secondary winding loosely magnetically coupled with said primary winding by a main magnetic core portion of said transformer and connected in series electrical circuit with said metal vapor electric discharge lamp, having the latter consist essentially the load in said circuit, and magnetic shunt core means, and means for said magnetic shunt core means to be controlled to move to and from any one of at least two positions relative to said main magnetic core portion, said magnetic shunt core means in a first of said positions being substantially fully magnetically isolated from said main magnetic core portion to have said main magnetic core portion link magnetic flux from said primary winding with said secondary winding, and said magnetic shunt core means in the other of said positions, including a second position, being within the magnetic field of said main magnetic core portion and forming a magnetic shunt path with said main magnetic core portion physically between said primary and secondary windings to have said main magnetic core portion link a reduced amount of magnetic flux from said primary winding with said secondary winding, and said transformer and said low-medium-high pressure metal vapor electric discharge lamp being interrelated with one another according to properties so that with said magnetic shunt core means being in said first position said secondary winding is energized on operation of said transformer to have a relatively high power output level for striking an arc at a relatively high voltage across said metal vapor electric discharge lamp, whereupon voltage across said lamp sharply drops and current through said lamp sharply increases and is limited by impedance of said transformer, and with continued operation of said metal vapor electric discharge lamp, current through said lamp is decreased as voltage across said lamp increases for current and voltage across said metal vapor electric discharge lamp to stabilize at a relatively high radiation power level of operation of said metal vapor electric discharge lamp, and so that upon movement of said magnetic shunt core means from said first position to said second position relative to said main magnetic core portion in response to operation of said control means, operation of said transformer and said metal vapor electric discharge lamp is continued and said secondary winding is energized to have a relatively low power output level and said metal vapor electric discharge lamp accordingly thereafter stably operates at a radiation power level being less than about 70% full radiation power of said lamp.

2. In a metal vapor electric discharge lamp system according to claim 1 wherein said metal vapor electric discharge lamp with said magnetic core means in said second position operates on power of said transformer at a radiation power level which is in the general environs of 20% maximum radiation power of said lamp.

3. In a metal vapor electric discharge lamp system according to claim 1 wherein said magnetic shunt core means is movable to and from said first and second positions and to at least one position intermediate said first and second positions and is driven by power drive means in response to operation of said control means for selecting said position, and for said transformer, with said magnetic shunt core means being in said intermediate position, to operate said metal vapor electric discharge lamp at an intermediate radiation power level of said lamp depending upon the particular intermediate position of said magnetic shunt core means.

4. In a metal vapor electric discharge lamp system according to claim 1 wherein said magnetic shunt core means is manually driven to and from said first and second positions and to at least one position intermediate said first and second positions by operation of said control means to select said position, and for said transformer, with said magnetic shunt core means being in said intermediate position, to operate said metal vapor electric discharge lamp at a radiation power level depending upon the particular intermediate position of said magnetic shunt core means.

5. In a metal vapor electric discharge lamp system according to claim 1 wherein said shunt core means is adapted to be manually moved from said first position suddenly to said second position to have said radiation power level of operation of said lamp diminish.

6. In a metal vapor electric discharge lamp system according to claim 1 wherein said shunt core means is movable from said first position suddenly to said second position, and said shunt core means is driven by quick-acting power drive means controlled for suddenly moving said shunt core means from said first position to said second position to have the radiation power level of operation of said lamp diminish.

7. In a metal vapor electric discharge lamp system according to claim 1 wherein said system includes a motor to be controlled for driving said shunt core means, and said control means includes means for controlling said motor to drive said shunt core means to said first position should said shunt core means be in any of said positions other than said first position, and then be stopped for said shunt core means to be in said first position while said metal vapor electric discharge lamp is starting in a first stage of operation of said system.

8. In a metal vapor electric discharge lamp system according to claim 1 wherein said system includes a motor to be controlled and drive said shunt core means in either of opposite directions, and said control means includes means for controlling said motor to drive said shunt core means in the first of said directions to said first position, should said shunt core means be in any one of said positions other than said first position, and then be stopped for said shunt core means to be in said first position while said metal vapor electric discharge lamp is starting in a first stage of operation of said system and is to reach a relatively high radiation power level of operation in a second operating stage of said system, and for said motor to be controlled during said second operating stage of said system for driving said shunt core means in the second of said directions from said first position to another of said positions and be stopped in the latter said position for said metal vapor electric discharge lamp to operate at a lower radiation power level than with said shunt core means being in said first position.

9. In a metal vapor electric discharge lamp system according to claim 1 wherein said control means includes feedback means for sensing quantitative and zero error between a reference voltage and voltage proportional to the current through said metal vapor electric discharge lamp during said first stage of operation of said system and controlling said motor, on said voltage error being quantitative and with said shunt core means being in any of said positions other than said first position, to drive said shunt core means to said first position wherein said quantitative error is erased to zero in said feedback means and said motor is stopped.

10. In a metal vapor electric discharge lamp system according to claim 8 wherein said control means includes feedback means for sensing plus, minus and zero error between a selective reference voltage and voltage proportional to current through said metal vapor electric discharge lamp during said second stage of operation of said system and controlling said motor to drive said shunt core means from any of said positions to another of said positions in a direction of drive according to sign of said voltage error to a destined one of said positions wherein said error is erased to zero in said feedback means.

11. In a metal vapor electric discharge lamp system according to claim 9 wherein said control means includes feedback means determining plus, minus and zero error between a selective reference voltage and voltage proportional to current through said lamp during said second stage of operation of said system and controlling said motor to drive said shunt core means, with said direction of drive being according to sign of said voltage error, from any of said first, second and intermediate positions to a destined other of said positions wherein said voltage error becomes zero.

12. In a metal vapor electric discharge lamp system according to claim 8 wherein said system is characterized by including timed switch means for switching from said first stage of operation to said second stage of operation.

13. In a metal vapor electric discharge lamp system according to claim 8 wherein said system is characterized by including automatic switch means for automatically selecting said first stage of operation of said system for said lamp to be started and said second stage of operation of said system for said lamp to be controlled after being started.

14. In a metal vapor electric discharge lamp system according to claim 13 wherein said automatic switch means is electro-thermally controlled.

15. In a metal vapor electric discharge lamp system according to claim 1 wherein said system includes a reversible motor to be controlled for driving said shunt core means to and from said positions relative to said main magnetic core portion, and said control means includes feedback means sensitive to current in the energizing circuit of said lamp and controlled for controlling said motor to operate in forward and reverse directions and drive said shunt core means to and from any of said positions selectively and then be stopped, said feedback means comprising comparator means connected for comparing a first voltage signal representative of the current in the energizing circuit of said lamp with a reference second voltage, thus producing a zero, plus or minus error voltage signal, and a switching circuit connected with said comparator means and said reversible motor for controlling said motor to operate in forward or reverse directions depending upon polarity of said voltage signal and be stopped in a destined one of said positions in response to said error signal being zero.

16. In a metal vapor electric discharge lamp system according to claim 15 wherein said motor is a reversible d.c. motor connected in a power supply circuit including a source of alternating current power supply, and said switching circuit includes switching and diode means connected in said power supply circuit for operating said motor in forward and reverse directions on current derived either from positive going half cycles of said alternating current power supply for one of said directions or from negative going half cycles of said alternating current power supply for the other of said directions.

17. In a metal vapor electric discharge lamp system according to claim 16 wherein said switching circuit includes a pair of darlington transistors controlled in response to said error voltage signal in said switching circuit and having collector-emitter paths connected in the energizing circuit of said reversible d.c. motor with a pair of diodes and a source of alternating current power supply, for controlling said reversible d.c. motor to operate in one direction on positive going half cycles of said alternating current power supply and in a reverse direction on negative going half cycles of said alternating current power supply, depending upon whether said error voltage signal is positive or negative, and said motor to be de-energized when said error voltage signal is zero.

18. In a metal vapor electric discharge lamp system according to claim 1 wherein said system includes a motor to be controlled and drive said shunt core means to and from said positions relative to said main core portion, and said control means include feedback means sensitive to current in the energizing circuit by said lamp and controlled for controlling said motor to drive said shunt core means to and from any of said positions selectively and there be stopped.

* * * * *